US006125546A

United States Patent [19]

Laws et al.

[11] Patent Number: 6,125,546

[45] Date of Patent: Oct. 3, 2000

[54] BULLNOSE CORNER BEAD SHEAR

[76] Inventors: Rick Asa Laws, 559 E. 2600 N., Provo, Utah 84604; James David Simpson, 1201 N. 600 East, Lehi, Utah 84043

[21] Appl. No.: 09/192,486

[22] Filed: Nov. 16, 1998

[51] Int. Cl.[7] ..... B26B 13/08

[52] U.S. Cl. ..... 30/257; 30/259

[58] Field of Search ..... 30/257, 261, 254, 30/234, 244, 225, 104, 90.1, 131, 356, 346, 357, 178, 229, 250, 120; 81/9.4, 9.44, 1

[56] References Cited

U.S. PATENT DOCUMENTS

| | | | |
|---|---|---|---|
| 812,645 | 2/1906 | Gardner | 30/229 |
| 1,354,755 | 10/1920 | Hultman | 30/250 |
| 1,577,140 | 3/1926 | Mitchell | 30/250 |
| 1,816,056 | 7/1931 | Richard | 30/257 |
| 2,090,228 | 9/1937 | Porter et al. | 30/357 |
| 3,883,951 | 5/1975 | Farrell | 30/257 |
| 4,285,344 | 8/1981 | Marshall | 30/257 |
| 4,462,157 | 7/1984 | Aiken | 30/259 |
| 4,502,484 | 3/1985 | Giampapa et al. | 30/356 |
| 4,753,011 | 6/1988 | Long | 30/258 |
| 5,590,470 | 1/1997 | Erbrick et al. | 30/250 |
| 5,699,617 | 12/1997 | Mock | 30/254 |

FOREIGN PATENT DOCUMENTS

| | | | |
|---|---|---|---|
| 7084 | 7/1893 | Switzerland | 30/120 |

*Primary Examiner*—Rinaldi I. Rada
*Assistant Examiner*—Omar Flores Sánchez
*Attorney, Agent, or Firm*—Douglas E. Mackenzie

[57] ABSTRACT

A bullnose corner bead shear for making internal angle corner cuts to bullnose corner bead. The device includes a first cutting head having a first cutting member and a second cutting member, the first cutting member further comprising a cutting blade having a linear cutting edge portion and a curvilinear cutting edge portion, the second cutting member further comprising a cutting blade having a linear cutting edge portion and a curvilinear cutting edge portion, the first and second cutting member cutting blade curvilinear edge portions being contoured in such manner that they extend in a first direction distal of a line of the corresponding linear cutting edge portion and a second direction perpendicular to a plane of the corresponding cutting member, a handle assembly having a first handle and a second handle, the first handle being attachable to a first cutting member leg and the second handle being attachable to a second cutting member leg, and a pivot pin for pivotally attaching the first cutting member and the second cutting member such that when the first handle and the second handle are biased toward each other the first cutting member cutting blade cuttably engages the second cutting member cutting blade.

4 Claims, 2 Drawing Sheets

BULLNOSE CORNER BEAD SHEAR

BACKGROUND OF THE INVENTION

1. Field of the Invention

The present invention relates to hand operated shears and more particularly pertains to a new bullnose corner bead shear for making internal angle corner cuts to bullnose corner bead.

The use of conventional shears requires that multiple motions be made when making an internal angle corner cut. The resulting edges are oftentimes jagged and difficult to align in the corner. Furthermore, the jagged edges do not provide for a smooth corner.

The bullnose corner bead shear of the present invention effectively addresses these problems.

2. Description of the Prior Art

The use of hand operated shears is known in the prior art. More specifically, hand operated shears heretofore devised and utilized are known to consist basically of familiar, expected and obvious structural configurations, notwithstanding the myriad of designs encompassed by the crowded prior art which have been developed for the fulfillment of countless objectives and requirements.

Known prior art hand operated shears include U.S. Pat. No. 4,462,157 and U.S. Pat. No. 4,753,011.

While these devices fulfill their respective, particular objectives and requirements, the aforementioned patents do not disclose a new bullnose corner bead shear. The inventive device includes a first cutting head having a first cutting member and a second cutting member, the first cutting member further comprising a cutting blade having a linear cutting edge portion and a curvilinear cutting edge portion, the second cutting member further comprising a cutting blade having a linear cutting edge portion and a curvilinear cutting edge portion, the first and second cutting member cutting blade curvilinear edge portions being contoured in such manner that they extend in a first direction distal of a line of the corresponding linear cutting edge portion and a second direction perpendicular to a plane of the corresponding cutting member, a handle assembly having a first handle and a second handle, the first handle being attachable to a first cutting member leg and the second handle being attachable to a second cutting member leg, and a means for pivotally attaching the first cutting member and the second cutting member such that when the first handle and the second handle are biased toward each other the first cutting member cutting blade cuttably engages the second cutting member cutting blade.

In these respects, the bullnose corner bead shear according to the present invention substantially departs from the conventional concepts and designs of the prior art, and in so doing provides an apparatus primarily developed for the purpose of making internal angle corner cuts to bullnose corner bead.

SUMMARY OF THE INVENTION

In view of the foregoing disadvantages inherent in the known types of hand operated shears now present in the prior art, the present invention provides a new bullnose corner bead shear construction wherein the same can be utilized for making internal angle corner cuts to bullnose corner bead.

The general purpose of the present invention, which will be described subsequently in greater detail, is to provide a new bullnose corner bead shear apparatus and method which has many of the advantages of the hand operated shears mentioned heretofore and many novel features that result in a new bullnose corner bead shear which is not anticipated, rendered obvious, suggested, or even implied by any of the prior art hand operated shears, either alone or in any combination thereof.

To attain this, the present invention generally comprises a first cutting head having a first cutting member and a second cutting member, the first cutting member further comprising a cutting blade having a linear cutting edge portion and a curvilinear cutting edge portion, the second cutting member further comprising a cutting blade having a linear cutting edge portion and a curvilinear cutting edge portion, the first and second cutting member cutting blade curvilinear edge portions being contoured in such manner that they extend in a first direction distal of a line of the corresponding linear cutting edge portion and a second direction perpendicular to a plane of the corresponding cutting member, a handle assembly having a first handle and a second handle, the first handle being attachable to a first cutting member leg and the second handle being attachable to a second cutting member leg, and a means for pivotally attaching the first cutting member and the second cutting member such that when the first handle and the second handle are biased toward each other the first cutting member cutting blade cuttably engages the second cutting member cutting blade.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bullnose corner bead shear apparatus and method which has many of the advantages of the hand operated shears mentioned heretofore and many novel features that result in a new bullnose corner bead shear which is not anticipated, rendered obvious, suggested, or even implied by any of the prior art hand operated shears, either alone or in any combination thereof.

It is another object of the present invention to provide a new bullnose corner bead shear which may be easily and efficiently manufactured and marketed.

It is a further object of the present invention to provide a new bullnose corner bead shear which is of a durable and reliable construction.

An even further object of the present invention is to provide a new bullnose corner bead shear which is susceptible of a low cost of manufacture with regard to both materials and labor, and which accordingly is then susceptible of low prices of sale to the consuming public, thereby making such bullnose corner bead shear economically available to the buying public.

Still yet another object of the present invention is to provide a new bullnose corner bead shear which provides in the apparatuses and methods of the prior art some of the advantages thereof, while simultaneously overcoming some of the disadvantages normally associated therewith.

Still another object of the present invention is to provide a new bullnose corner bead shear for making internal angle corner cuts to bullnose corner bead.

Yet another object of the present invention is to provide a new bullnose corner bead shear which includes a first cutting head having a first cutting member and a second cutting member, the first cutting member further comprising a cutting blade having a linear cutting edge portion and a curvilinear cutting edge portion, the second cutting member further comprising a cutting blade having a linear cutting edge portion and a curvilinear cutting edge portion, the first and second cutting member cutting blade curvilinear edge portions being contoured in such manner that they extend in a first direction distal of a line of the corresponding linear cutting edge portion and a second direction perpendicular to a plane of the corresponding cutting member, a handle assembly having a first handle and a second handle, the first handle being attachable to a first cutting member leg and the second handle being attachable to a second cutting member leg, and a means for pivotally attaching the first cutting member and the second cutting member such that when the first handle and the second handle are biased toward each other the first cutting member cutting blade cuttably engages the second cutting member cutting blade.

Still yet another object of the present invention is to provide a new bullnose corner bead shear that makes a smooth internal angle corner cut.

Even still another object of the present invention is to provide a new bullnose corner bead shear that eliminates the need for multiple cuts when cutting an internal angle corner cut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
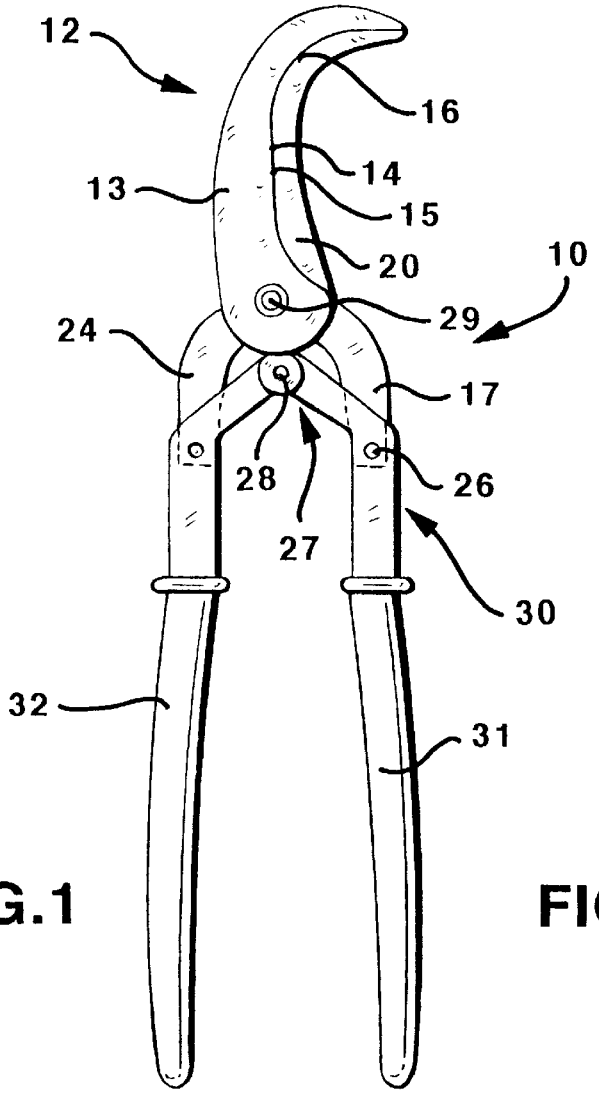
FIG. 1 is a front elevation view of a new bullnose corner bead shear according to the present invention.

With reference now to the drawings, and in particular to FIGS. 1 through 9 thereof, a new bullnose corner bead shear embodying the principles and concepts of the present invention and generally designated by the reference numeral 10 will be described.

More specifically, it will be noted that the bullnose corner bead shear 10 comprises a first cutting head 12 formed of steel and having a first cutting member 13 and a second cutting member 20. The first cutting member 13 includes a cutting blade 14 and the second cutting member includes a cutting blade 21. Each cutting member further includes an integral leg 17,24 to which is attachable a handle assembly 30. The first and second cutting members 13,20 are pivotally attached by means of pivot pin 29 in such manner that when a first handle 31 and a second handle 32 are biased toward each other, a first cutting member cutting blade 14 cuttably engages a second cutting member cutting blade 21 and thereby forms a first cut of the internal angle corner cut. A third cutting head 60 is used to cut the remaining uncut flange portion. A second cutting head 40 is used to cut the other section of bullnose corner bead to form the internal angle corner bead.

Figure 2:
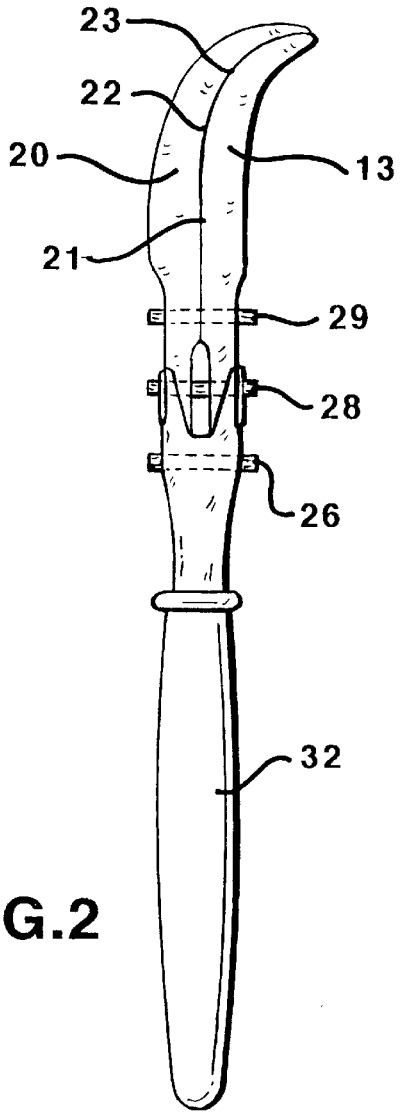
FIG. 2 is a side elevation view thereof.

With reference to FIGS. 1 and 2 the bullnose corner bead shear 10 is shown including a first cutting head 12. The cutting head includes a first cutting member 13 and a second cutting member 20. The first cutting member 13 includes a cutting blade 14 having a linear cutting edge portion 15 and a curvilinear cutting edge portion 16. The second cutting member 20 includes a cutting blade 21 having a linear cutting edge portion 22 and a curvilinear cutting edge portion 23.

Figure 5:
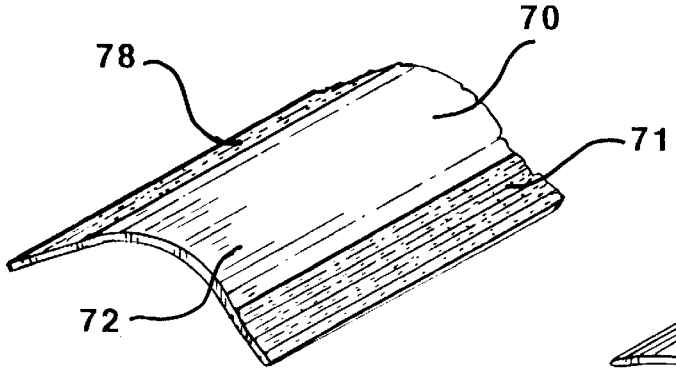
FIG. 5 is a perspective view of a section of bullnose corner bead.
Figure 9:
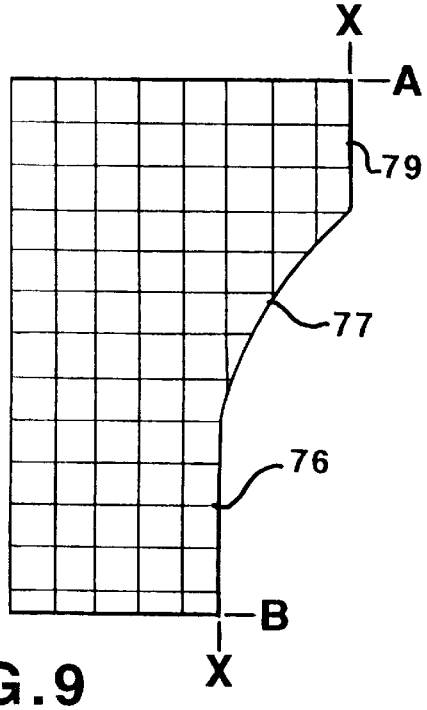
FIG. 9 is a plane projection of the internal angle corner cut.

The linear cutting edge portions 15,22 are adapted to cut a linear cut 76 of a first flange 71 of the bullnose corner bead 70, which for illustrative purposes has a radius of one half inch (FIGS. 5 and 9). The curvilinear cutting edge portions 16,23 are adapted to cut a curvilinear cut 77 of a corner contour surface 72 of the bullnose corner bead 70. Considering that the corner contour surface 72 is not flat, the first and second cutting member blade curvilinear cutting edge portions 16,23 are shown contoured in such manner that they extend in a first direction distal of a line of the corresponding linear cutting edge portions 15,22 and a second direction perpendicular to a plane of the corresponding cutting member 13,20.

A handle assembly 30 is shown having a first handle 31 and a second handle 32. The first and second handles 31,32 are preferably manufactured of steel and covered in a rubber material. The first handle 31 is attachable to a first cutting member leg 17 and the second handle 32 is attachable to a second cutting member leg 18 by conventional means such as by spring ball pins 26 or cotter pins (not shown). The handle assembly 30 further includes a means for biasing the first handle 31 apart from the second handle 32. A conventional biasing means 27 is shown including a means for pivoting about a pin 28, such as a spring.

Figure 3:
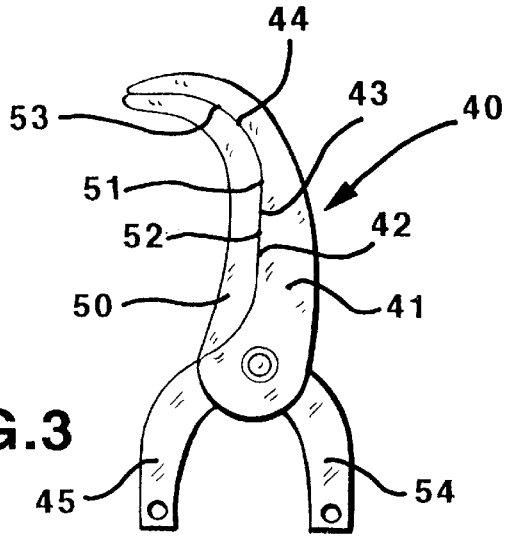
FIG. 3 is front elevation view showing an alternative cutting head.

With reference to FIG. 3 the second head 40 is shown including a first cutting member 41 and a second cutting member 50. The first and second cutting members 41,50 include integrally formed legs 45,54 to which are attachable the handle assembly 30. The first cutting member 41 includes a cutting blade 41 having a linear cutting edge portion 43 and a curvilinear cutting edge portion 44. The second cutting member 50 includes a cutting blade 51 having a linear cutting edge portion 52 and a curvilinear cutting edge portion 53. The first and second cutting member blade curvilinear cutting edge portions 44,53 are shown contoured in such manner that they extend in a third direction distal of a line of the corresponding linear cutting edge portions 43,52 and a fourth direction perpendicular to a plane of the corresponding cutting member 41,50. The second cutting head 40 is adapted to cut a mirror image of the internal corner angle cut (76,77) of FIG. 9.

Figure 4:
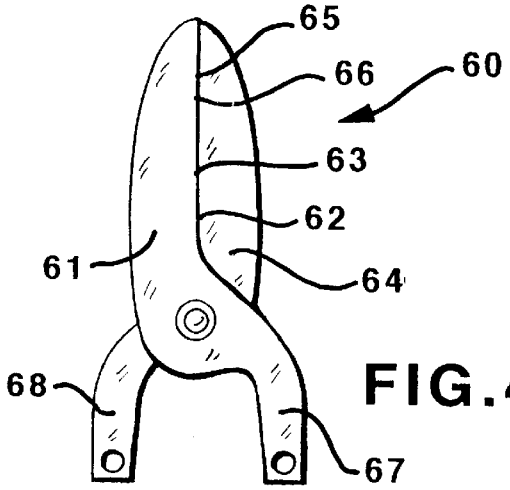
FIG. 4 is a front elevation view showing yet another cutting head.

With reference to FIG. 4 the third cutting head 60 is shown including a first cutting member 61 and a second cutting member 64. The first and second cutting member 61,64 includes integrally formed legs 67,68 to which are attachable the handle assembly 30. The first cutting member 61 includes a cutting blade 62 having a linear cutting edge portion 63 and the second cutting member 64 includes a cutting blade 65 having a linear cutting edge portion 66. The linear cutting edge portions 63,66 are adapted to cut the linear cut 79 of second flange portion 78 as graphically shown in FIG. 9.

Figure 6:
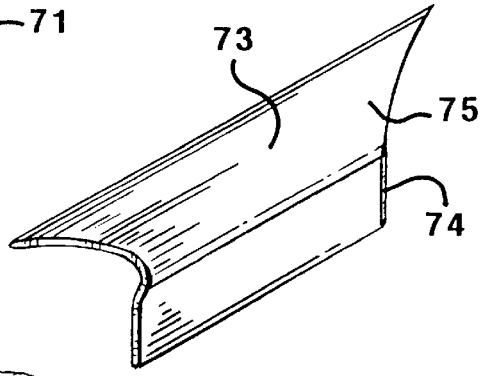
FIG. 6 is a perspective view of a template used to mark the bullnose corner bead for cutting of the internal angle corner cut.
Figure 7:
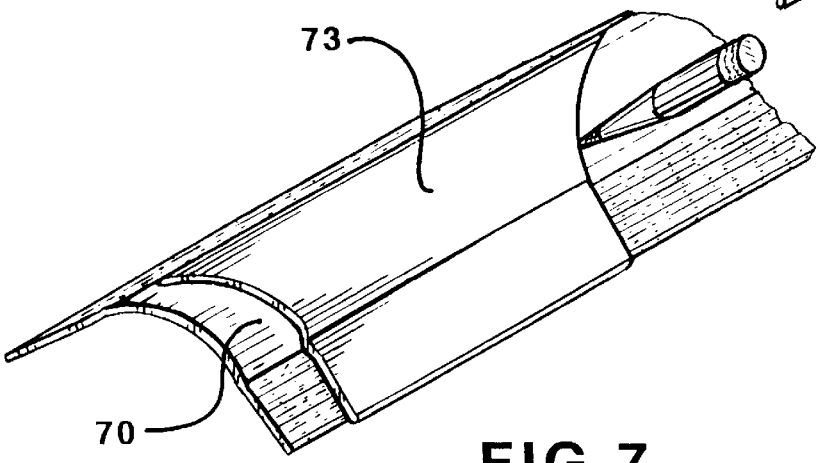
FIG. 7 is a perspective view showing the template in use.
Figure 8:
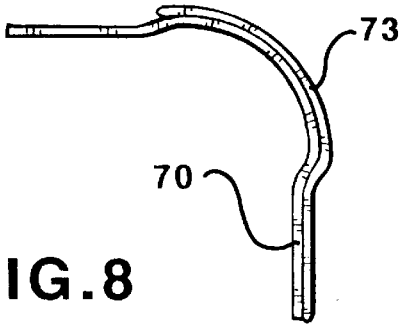
FIG. 8 is an end view of FIG. 7.

In use, a template 73 may be employed to facilitate the cutting of the internal angle corner cut as shown in FIGS. 6 through 8. The template includes two linear portions 74 and two curvilinear portions 75. The bull nose corner bead 70 may be marked as shown in FIG. 7 prior to making the internal angle corner cut with the first cutting head 12. Alternatively, the first cutting head 12 may be used without first marking the bull nose corner bead 70. The second section of bull nose corner bead 70 could be marked and cut in a similar fashion by using the opposite linear portion 74 and curvilinear portion 75 of the template 73 and employing the second cutting head 40. Alternatively, the second cutting head 40 may be used without first marking the bull nose corner bead 70. The third cutting head 60 would be used to make the final linear cut 79 (FIG. 9). By using the first, second, and third cutting heads 12, 40, and 60, as described, an internal angle cut of 90 degrees is achieved.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bullnose corner bead shear for cutting an internal angle corner cut comprising:

a first cutting head having a first cutting member and a second cutting member, the first cutting member further comprising a cutting blade having a linear cutting edge portion and a curvilinear cutting edge portion, the second cutting member further comprising a cutting blade having a linear cutting edge portion and a curvilinear cutting edge portion, the first and second cutting member cutting blade curvilinear cutting edge portions being contoured in such manner that they extend in a first direction distal of a line of the corresponding linear cutting edge portion and a second direction perpendicular to a plane of the corresponding cutting member;

a handle assembly having a first handle and a second handle, the first handle being attachable to a first cutting member leg and the second handle being attachable to a second cutting member leg; and a means for pivotally attaching the first cutting member and the second cutting member such that when the first handle and the second handle are biased toward each other the first cutting member cutting blade engages the second cutting member cutting blade to cut an internal angle corner cut.

2. The bullnose corner bead shear of claim 1, wherein the handle assembly further comprises a means for biasing the first handle apart from the second handle.

3. The bullnose corner bead shear of claim 1 further comprising a second cutting head having a first cutting member and a second cutting member, the first cutting member further comprising a cutting blade having a linear cutting edge portion and a curvilinear cutting edge portion, the second cutting member further comprising a cutting blade having a linear cutting edge portion a curvilinear cutting edge portion, the first and second cutting member cutting blade curvilinear cutting edge portions being contoured in such manner that they extend in a third direction distal from a line of the corresponding linear cutting edge portion and a fourth direction perpendicular to a plane of the corresponding cutting member.

4. The bullnose corner bead shear of claim 3 further comprising a third cutting head having a first cutting member and a second cutting member, the first cutting member further comprising a cutting blade having a linear cutting edge portion, the second cutting member further comprising a cutting blade having a linear cutting edge portion.

* * * * *